US005352145A

United States Patent [19]

Raiffe et al.

[11] Patent Number: 5,352,145

[45] Date of Patent: Oct. 4, 1994

[54] CHILD'S MOBILE AND IMPROVED ELEMENT CLAMP THEREFOR

[75] Inventors: Rita Raiffe, Far Hills; Robert W. Shaw, Piscataway, both of N.J.

[73] Assignee: Gund, Inc., Edison, N.J.

[21] Appl. No.: 744,924

[22] Filed: Aug. 14, 1991

Related U.S. Application Data

[63] Continuation-in-part of Ser. No. 625,603, Dec. 11, 1990.

[51] Int. Cl.[5] ..... A63H 33/00; A63H 21/02; A63H 1/06; A41F 1/00

[52] U.S. Cl. ..... 446/227; 446/228; 446/246; 40/617; 24/563; 24/457

[58] Field of Search ..... 446/227, 228, 236, 242, 446/246; 40/617, 666; 24/563, 562, 545, 457

[56] References Cited

U.S. PATENT DOCUMENTS

| | | | |
|---|---|---|---|
| 1,477,256 | 12/1923 | Fritz | 24/545 |
| 1,687,361 | 10/1928 | Carroll et al. | 40/666 |
| 2,591,169 | 6/1991 | Levine | 211/119.12 |
| 2,632,930 | 3/1953 | Donahue | 24/344 |
| 3,013,654 | 12/1961 | Hoff | 24/562 X |
| 3,204,313 | 9/1965 | See | 24/562 X |
| 3,214,813 | 11/1965 | Goldman | 24/562 |
| 3,699,704 | 10/1972 | Hakim | 446/227 |
| 3,797,076 | 3/1974 | Watkin | 24/562 |
| 3,992,749 | 11/1976 | Getchell | 16/93 D |
| 4,170,299 | 10/1979 | Clements | 24/243 R |
| 4,363,181 | 12/1982 | Hyman et al. | 446/242 X |
| 4,654,991 | 4/1987 | Jones | 40/617 |
| 4,738,007 | 4/1988 | Demarest, Jr. | 24/563 X |
| 4,756,109 | 7/1988 | Marcus | 40/617 X |
| 4,876,771 | 10/1989 | Givati | 24/298 |
| 4,904,220 | 2/1990 | Williams | 446/227 |
| 4,947,524 | 8/1990 | Chang | 24/563 X |
| 4,984,380 | 1/1991 | Anderson | 446/227 X |

FOREIGN PATENT DOCUMENTS

| | | | |
|---|---|---|---|
| 4883 | 1/1892 | United Kingdom | 24/562 |

*Primary Examiner*—Mickey Yu
*Assistant Examiner*—D. Neal Muir
*Attorney, Agent, or Firm*—Gottlieb, Rackman & Reisman

[57] ABSTRACT

An improved child's mobile is disclosed including a plurality of decorative elements, and the resulting mobile, is described wherein each of a plurality of decorative elements is inserted into the improved element clamp at different, reversible orientations. By removing and reinserting the mobile elements at different orientations the child is exposed to various shapes and colors as frequently as desired.

7 Claims, 2 Drawing Sheets

CHILD'S MOBILE AND IMPROVED ELEMENT CLAMP THEREFOR

CROSS-REFERENCE TO RELATED APPLICATION

This application is a continuation-in-part of application Ser. No. 625,603 (Design Application) filed on Dec. 11, 1990.

FIELD OF THE INVENTION

This invention relates to children's mobiles of the type normally suspended over a child's crib.

DESCRIPTION OF THE PRIOR ART

Mobiles are often attached to the side of a child's crib and include colorful and decorative elements which are designed to capture the baby's attention. Typically, such elements may include animals, cars, faces, etc. U.S. Pat. No. 4,904,220 teaches a baby mobile comprising a plurality of elements suspended from support panels. The plurality of elements may be removed from the mobile and placed on a nightstand for enjoyment by the child.

U.S. Pat. No. 4,654,991 discloses another baby mobile for visually displaying toys, dolls or the like within a child's room. The items are attached to hanging straps for the purpose of storing the items and the straps may be secured at their upper ends to the carrier arms of a carousel.

SUMMARY OF THE INVENTION

The present invention is an improved element clamp intended to be attached to the spindle of a child's mobile, and the resulting improved child's mobile. In accordance with the invention, each of a plurality of decorative elements is attached to the mobile's spindle by means of an element clamp, each element clamp including two elongated essentially parallel fingers which may be optionally biased towards each other. One of said fingers preferably includes one or more holes therealong for suspension via a string from the mobile spindle.

Each decorative element is inserted into one of said element clamps and may be removed and inserted at a different orientation, i.e., upside down, where the different orientation appears as a different visual element to the child viewing the mobile as a whole.

The invention allows the mobile, when viewed as a whole by the child, to appear differently when the decorative elements are reoriented. Moreover, each decorative element provides two completely distinct views to the child and thus, the mobile may be arranged to provide a large number of overall appearances to the child.

DETAILED DESCRIPTION

Figure 1:
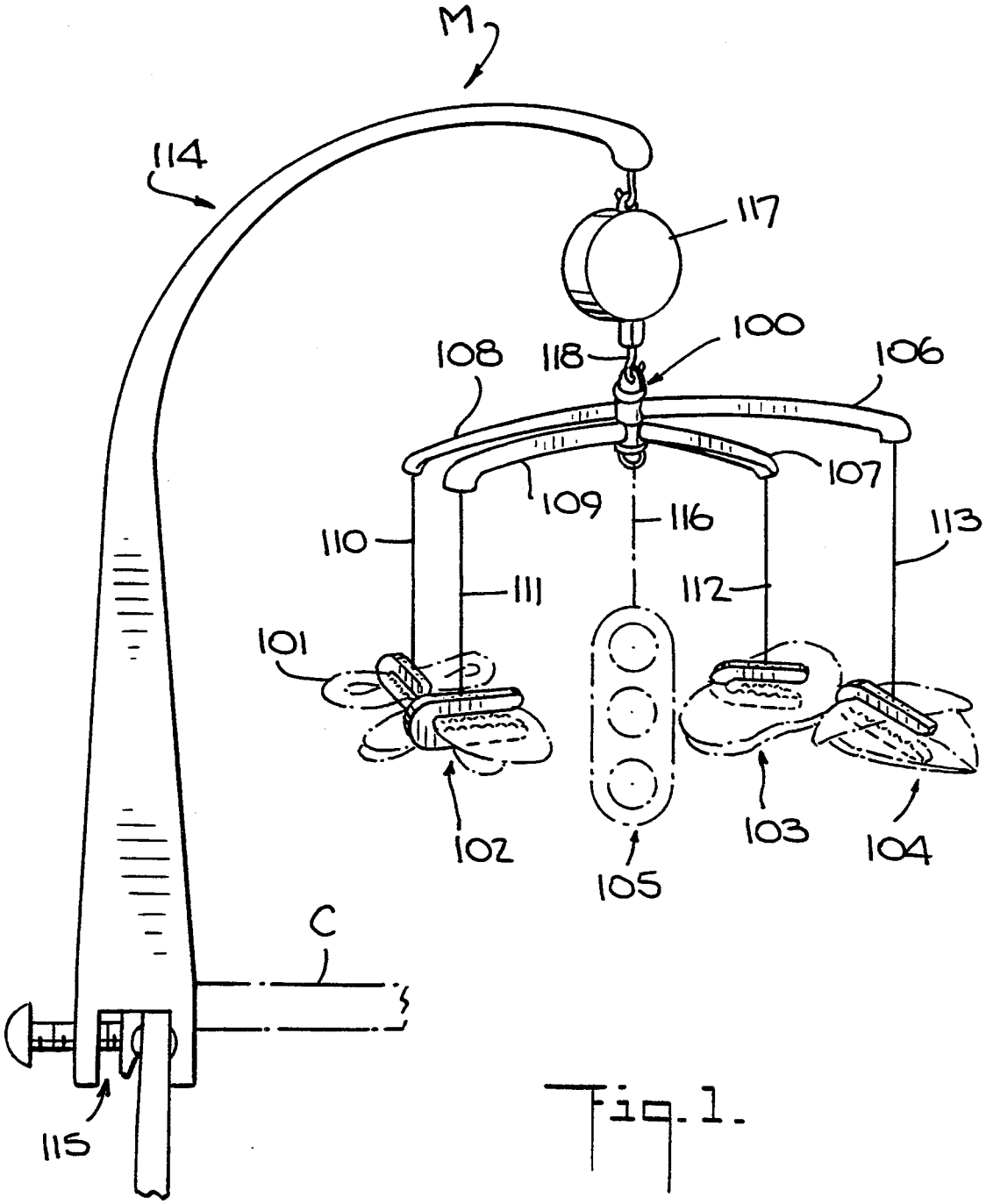
FIG. 1 is an exemplary embodiment of a child's mobile encompassing the inventive concept.

FIG. 1 is an exemplary embodiment of the invention in the form of a child's mobile M. The mobile M has a mobile spindle 100 including four mobile arms 106–109, optionally fixed at 90° to one another. Each arm, at its end, carries a separate one of the strings 110–113 and an attached element clamp, as described later herein. Additionally, optional central decorative element 105 is suspended via string 116 from the center of mobile spindle 100.

The mobile M further includes a vertically oriented curved support 114, which serves to suspend mobile spindle 100 above the child in a crib (see crib element C), curved support 114 being typically mounted to the child's crib via a suitable clamping member 115 as indicated. It should be understood however, that a variety of other means for connecting the mobile support 114 to the crib may be employed. Sound source 117 may optionally be included in an appropriate location in the mobile M in order to produce music. Sound source 117 may be of the windup type, or may be battery operated.

In operation, the decorative elements of the mobile exhibit random motion, intended to be visually attractive, due to the child or a parent touching it, breezes in the air, etc. Additionally, the elements may rotate as optional wind-up type sound source 117 unwinds, as by a rotative motion applied to a hook element 118. Such motion of the elements is pleasing to the child.

Figure 2:
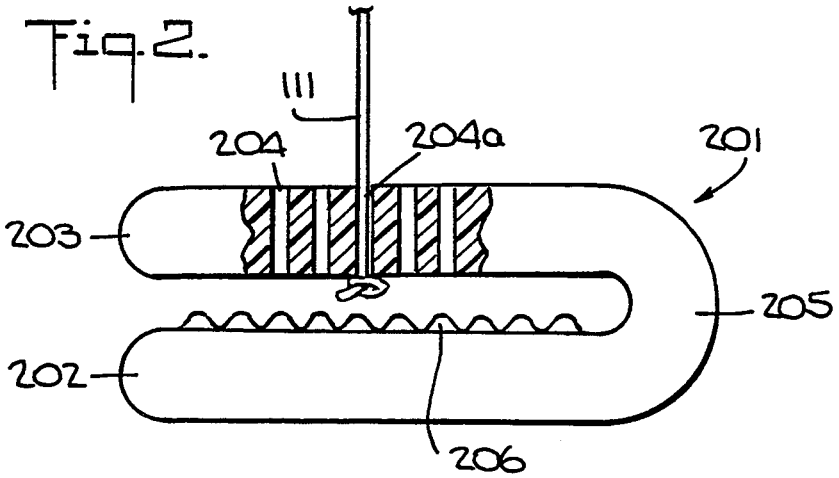
FIG. 2 is a side-elevational detailed and partially cross-sectional view of the improved element holder.

FIG. 2 is a closeup side elevational view of the improved element clamp for suspending the mobile's decorative elements from the strings 110–113, said strings being attached to the mobile arms as previously described. The element clamp 201 comprises two parallel fingers, an upper finger 203 and a lower finger 202 connected to each other at one end thereof by a bend 205 as shown. The clamp 201 is desirably formed of a plastic so that the fingers 202 and 203 are resilient.

Figure 3:
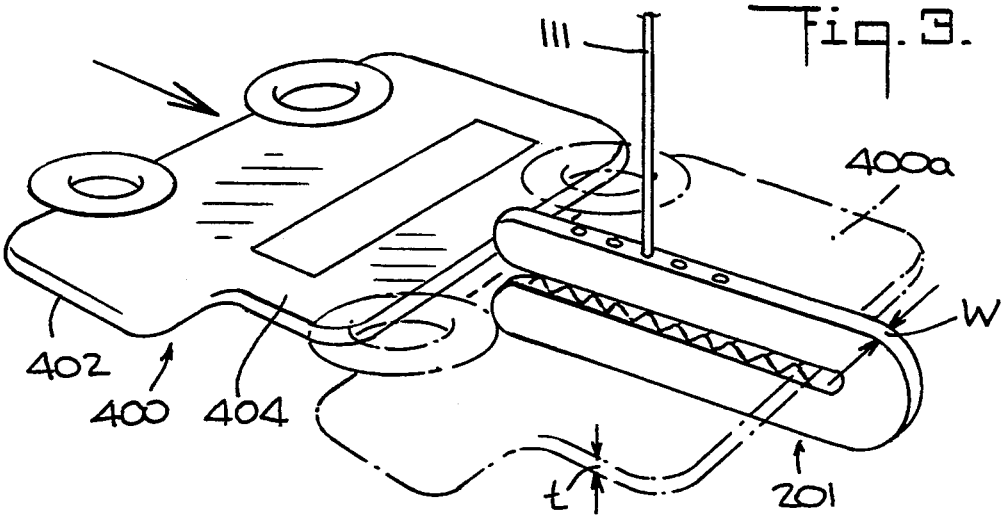
FIG. 3 shows the element clamp of FIG. 2 with an exemplary decorative element being inserted therein and, in phantom lines, the decorative element in its fully inserted position.

Fingers 202–203 are spaced apart by an appropriate amount to accommodate a decorative element and to secure it firmly therebetween. For example, fingers 202–203 may be spaced so that the gap between them is $\frac{3}{4}$ t, where t is the thickness of the decorative element as shown in FIG. 3. By providing a gap which is slightly less than the size of the decorative element to be accommodated therein, and further, by utilizing fingers formed of a somewhat resilient material as described previously, the fingers are pushed apart as the decorative element is inserted, and tend to close toward each other after the decorative element is fully inserted. In this manner, the fingers clamp down on the decorative element and secure it therebetween.

At least one of the fingers, usually the upper finger 203 in FIG. 2, includes one or more vertical holes 204, parallel therealong as shown in FIG. 2. The holes extend completely through upper finger 203, preferably in a direction substantially perpendicular to the longitudinal axis of element clamp 201. String 111 is threaded through one or more of these holes and used to attach the element clamp to one of mobile arms 106–109.

String 111 may be secured within the hole by using glue, or alternatively, may be pulled through hole **204*a* and secured therethrough by knotting the end as shown. At least one of the fingers, e.g., the lower finger 202, may be equipped with a plurality of teeth 206, arranged along its length as shown in FIG. 2, in order to better support and grip a decorative element which is inserted between fingers 202 and 203**.

Figure 4A:
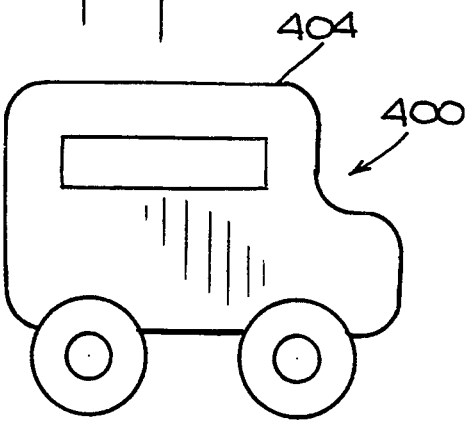
FIG. 4 shows two different views of the exemplary element of FIG. 3, one view (404) being of one side of said decorative element and the other view (402) showing the decorative element's reverse side.
Figure 4B:
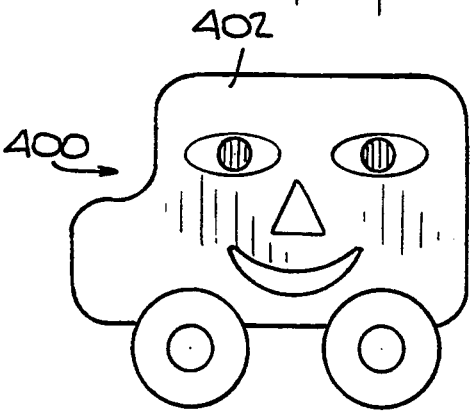

In accordance with the invention, a mobile decorative element 400 such as that shown in FIGS. 4A and 4B is inserted into the improved element clamp 201 between its fingers 202 and 203 as indicated in FIG. 3. Importantly, the width of fingers 202 and 203 of element clamp 201 is large enough, e.g., within the range of quarter of an inch, so that when the decorative element is inserted therebetween, the decorative element will remain in balance as it is suspended from the mobile. Thus, the decorative element will hang horizontally, and only one face thereof will be viewable by the child therebeneath. As can be seen in FIG. 2, decorative element 400 is in the shape of a truck, and the simulated face shown as 402 in FIG. 4 would be viewable to the child therebeneath when the decorative element is inserted in clamp 201 as shown by the phantom lines in FIG. 3.

Referring to FIG. 3, it can be seen that the lower face 402 of decorative element 400 shown in FIG. 4B would be visible to the child beneath the mobile. However, it can be seen that decorative element 400 may be removed, turned over, and reinserted element into clamp 201 so that the other face 404 of decorative element 400 shown in FIG. 4A, would be viewable by the child when the element is inserted in the element clamp 201 as shown by the phantom lines of FIG. 2.

A typical decorative element 400 is preferably made of plush fabric, which is both pleasing when viewed by the child, soft and pleasing to the child's touch, and perhaps most importantly, safe for use by the child. Each side is visually different, and the decorative element 400 should have a center of gravity that is coincident with the string when the decorative element is inserted fully into the element clamp. This will assist in keeping the element horizontally balanced when it is suspended. Moreover, as the child ages, the decorative elements may be replaced with new ones to reflect maturing interests.

While the above describes the preferred embodiments of the invention, it is understood that other variations may be constructed by those of ordinary skill in the art. Such variations are within the scope and spirit of the invention and are intended to be covered by the following claims.

We claim:

1. A child's mobile comprising:

a two-sided decorative element;

an element clamp for removably receiving said decorative element, the clamp including two longitudinal fingers, said longitudinal fingers being connected to each other at only one end thereof, at least one of said fingers having at least one hole therethrough; and a string, said string extending through said at least one hole such that said element clamp is substantially horizontally balanced when suspended from said string.

2. The mobile of claim 1 wherein at least one of said fingers comprises a plurality of teeth therealong for gripping said decorative mobile element.

3. The mobile of claim 1 wherein said decorative element comprises at least two visually distinct faces, one of said faces being visible from below said element clamp when said decorative element is inserted in said element clamp in a first orientation and another of said faces being visible from below said element clamp when said decorative element is inserted in said element clamp in a second orientation.

4. The mobile of claim 1 wherein said longitudinal fingers are of sufficient dimension such that said decorative element is substantially horizontally balanced when fully inserted in said element clamp.

5. Apparatus of claim 1 wherein said holes extend in a direction substantially perpendicular to said longitudinal fingers.

6. The mobile of claim 1 wherein said decorative element has vertical dimensions greater than the space between said fingers so that said fingers are pushed apart by insertion of said decorative element and said decorative element is held therebetween by the resiliency of said fingers.

7. The mobile of claim 1 further comprising a sound source for playing music.

* * * * *